United States Patent [19]

Hall

[11] Patent Number: 4,820,083

[45] Date of Patent: Apr. 11, 1989

[54] FLEXIBLE FLOWLINE CONNECTION TO A SUBSEA WELLHEAD ASSEMBLY

[75] Inventor: Johnce E. Hall, Kingwood, Tex.

[73] Assignee: Amoco Corporation, Chicago, Ill.

[21] Appl. No.: 114,474

[22] Filed: Oct. 28, 1987

[51] Int. Cl.[4] ..... F16L 1/04

[52] U.S. Cl. ..... 405/169; 166/347

[58] Field of Search ..... 166/77, 344, 346, 347; 405/169, 170, 195

[56] References Cited

U.S. PATENT DOCUMENTS

| | | | |
|---|---|---|---|
| 3,220,477 | 11/1965 | Jones | 166/342 |
| 3,298,092 | 1/1967 | Dozier et al. | 285/18 X |
| 3,307,631 | 3/1967 | Coberly et al. | 166/77 |
| 3,312,282 | 4/1967 | Yetman | 166/77 X |
| 3,356,136 | 12/1967 | Haeber | 166/346 X |
| 3,373,807 | 3/1968 | Fischer et al. | 166/345 X |
| 3,495,658 | 2/1970 | Johnson | 166/359 X |
| 3,710,859 | 1/1973 | Hanes et al. | 166/346 X |
| 3,721,294 | 3/1973 | Nelson | 166/343 X |
| 3,722,585 | 3/1973 | Nelson et al. | 166/346 X |
| 4,182,584 | 1/1980 | Panicker et al. | 405/195 |
| 4,230,186 | 10/1980 | Lewis, Jr. | 166/342 |
| 4,388,022 | 6/1983 | Gentry et al. | 405/195 |
| 4,400,110 | 8/1983 | Beynet et al. | 405/195 |
| 4,570,716 | 2/1986 | Genini et al. | 166/346 |
| 4,676,696 | 6/1987 | Laursen | 405/169 |
| 4,691,781 | 9/1987 | Gano | 166/368 |

*Primary Examiner*—David H. Corbin
*Assistant Examiner*—Arlen L. Olsen
*Attorney, Agent, or Firm*—Scott H. Brown; Fred E. Hook

[57] ABSTRACT

A flexible flowline support is disclosed, which can be connected to a subsea wellhead assembly preventing the flowline from being bent in too short of a radius. A flowline support base is connectable by way of guidelines to the subsea wellhead assembly and includes a flowline connector having a first end upwardly disposed and connected to the flowline support base and having a second end operatively connectable to the subsea wellhead assembly. A cradle assembly is mounted to the flowline support base adjacent the first end of the flowline connector and has an upper trough-like surface over which the flexible flowline can lay for connection to the first end of the flowline connector.

7 Claims, 4 Drawing Sheets

FLEXIBLE FLOWLINE CONNECTION TO A SUBSEA WELLHEAD ASSEMBLY

BACKGROUND OF THE INVENTION

Field of the Invention

The present invention relates to an apparatus and method connecting a flowline to a subsea wellhead assembly and, more particularly, to a flexible flowline connection that includes a cradle assembly for receiving flexible flowline thereacross to prevent the flowline from being bent in too short of a radius.

As oil and gas discoveries are made in deeper waters, there is a need for underwater flowline connection techniques that do not require divers and/or expensive specialized equipment. Specifically, in deeper waters, several remotely located wellhead assemblies provide their produced fluids to a central oil manifold on the seafloor or to an upper water production facility, such as a floating buoy or a fixed platform. The flowlines that connect such remote wellhead facilities can horizontally extend several miles in length.

In depths where divers cannot be utilized, it is extremely difficult to make horizontal connection of the flowline to the subsea wellhead. Various devices and methods have been developed in the past to permit the preferred and more easily accomplished vertical connection of the flowline to a subsea wellhead. Typical devices are shown in U.S. Pat. Nos. 3,373,807; 4,230,186; and 4,676,696. All of these patented devices use highly specialized and complex devices to permit the rotation and laying over of the flowline into a horizontal position. The utilization of these above methods have met with various success; however, they do require specially configured equipment. There is a need within the industry to lower equipment and installation costs; therefore, there is a need for a simplified flowline connection mechanism and method which does not require either divers or specialized equipment.

U.S. Pat. Nos. 3,220,477 and 4,400,110 both disclose flowline support mechanisms that prevent the flowline from being bent in too short of a radius. However, neither of these references disclose or suggest utilizing conventional guideline installation equipment to make a vertical connection to a conventional subsea wellhead assembly and utilizing a cradle assembly mounted to the subsea wellhead assembly to prevent undesired bending of the flowline.

SUMMARY OF THE INVENTION

The present invention has been contemplated to overcome the foregoing deficiencies and to meet the above described needs. Briefly, the present invention comprises a flexible flowline support which is integral to or adapted for connection to a subsea wellhead assembly. The flowline support base includes a flowline connector having a first end upwardly disposed and connected to the support base and having a second end operatively connectable to produced fluid valves and piping of the subsea wellhead assembly. A cradle assembly is mounted to the flowline support base adjacent the first end of the flowline connector and has an upper curved surface adapted to receive the flexible flowline for connection to the first end of the flowline connector.

The present invention permits the use of conventional guidelines to make a vertical connection of a flowline to a subsea wellhead assembly. Further, the present invention prevents the undesirable bending of the flexible flowline at the point of connection to the wellhead assembly.

DETAILED DESCRIPTION OF PREFERRED EMBODIMENTS

Disclosed herein is a flowline support base connectable to a subsea wellhead assembly, as will be described below, with a flowline connector having a first end upwardly disposed and connected to the flowline support base and having a second end operatively connected to the subsea wellhead assembly. A cradle assembly is mounted to the flowline support base adjacent the first end of the flowline connector and has a receiving surface over which the flexible flowline can lay for connection to the first end of the flowline connector.

Figure 1:
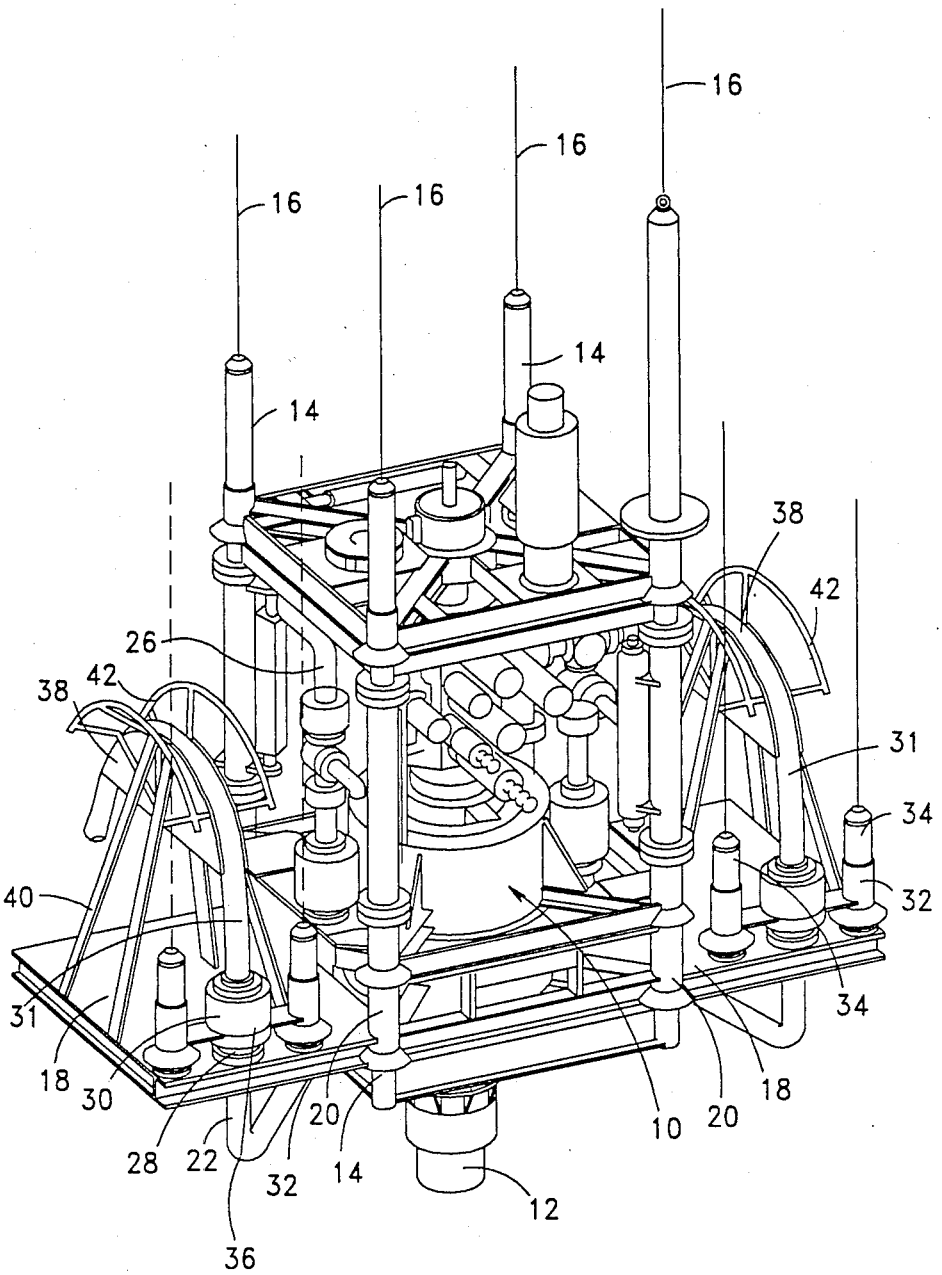
FIG. 1 is a perspective elevational view of a flexible flowline support, embodying the present invention, connected to a subsea wellhead assembly.
Figure 2A:
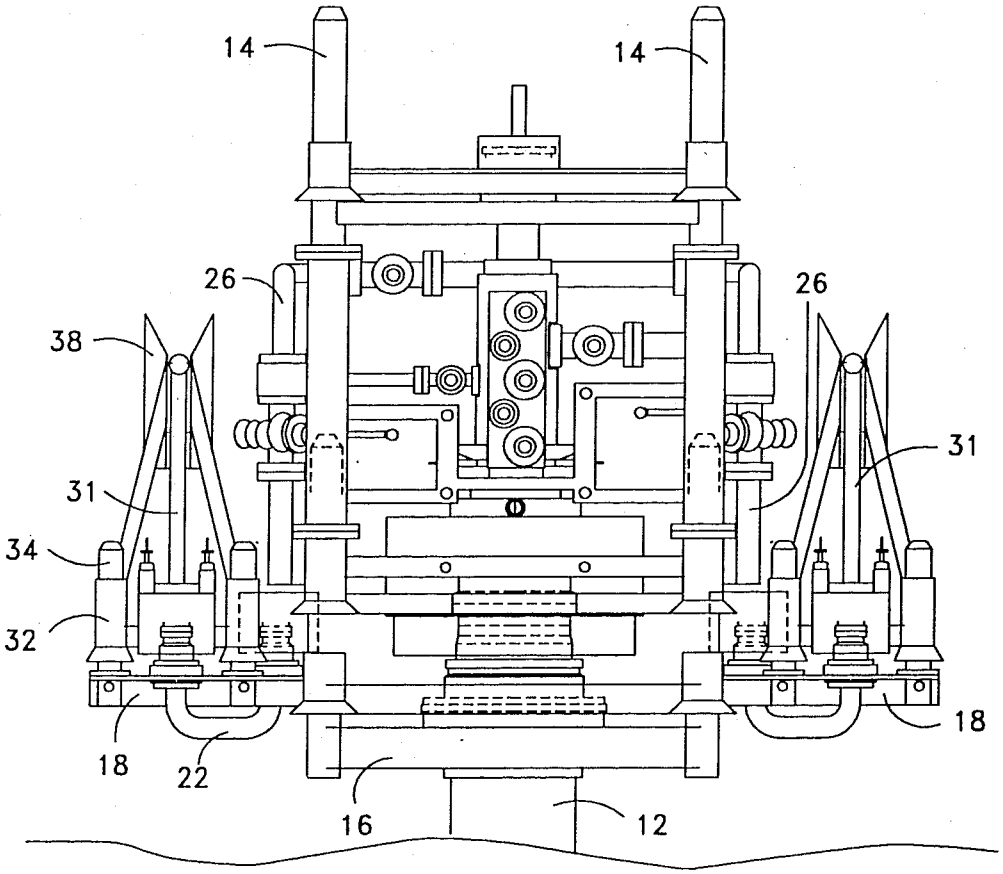
FIG. 2A is a front view of a flexible flowline support embodying the present invention.
Figure 2B:
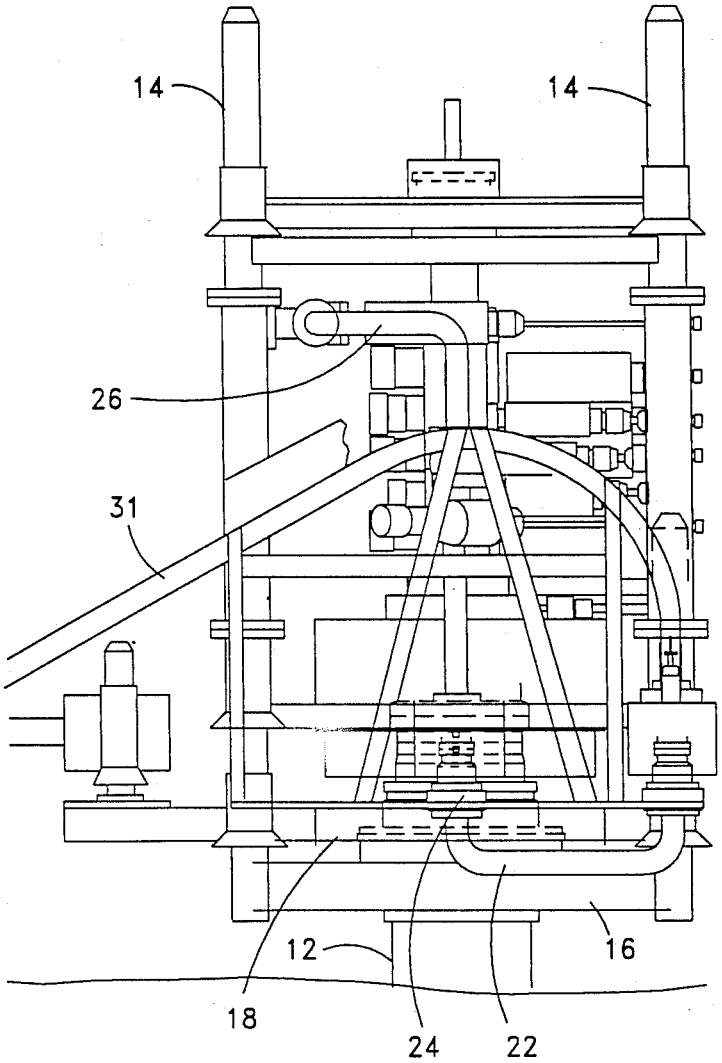
FIG. 2B is a left side elevational view of the flexible flowline support of FIG. 2A.
Figure 2C:
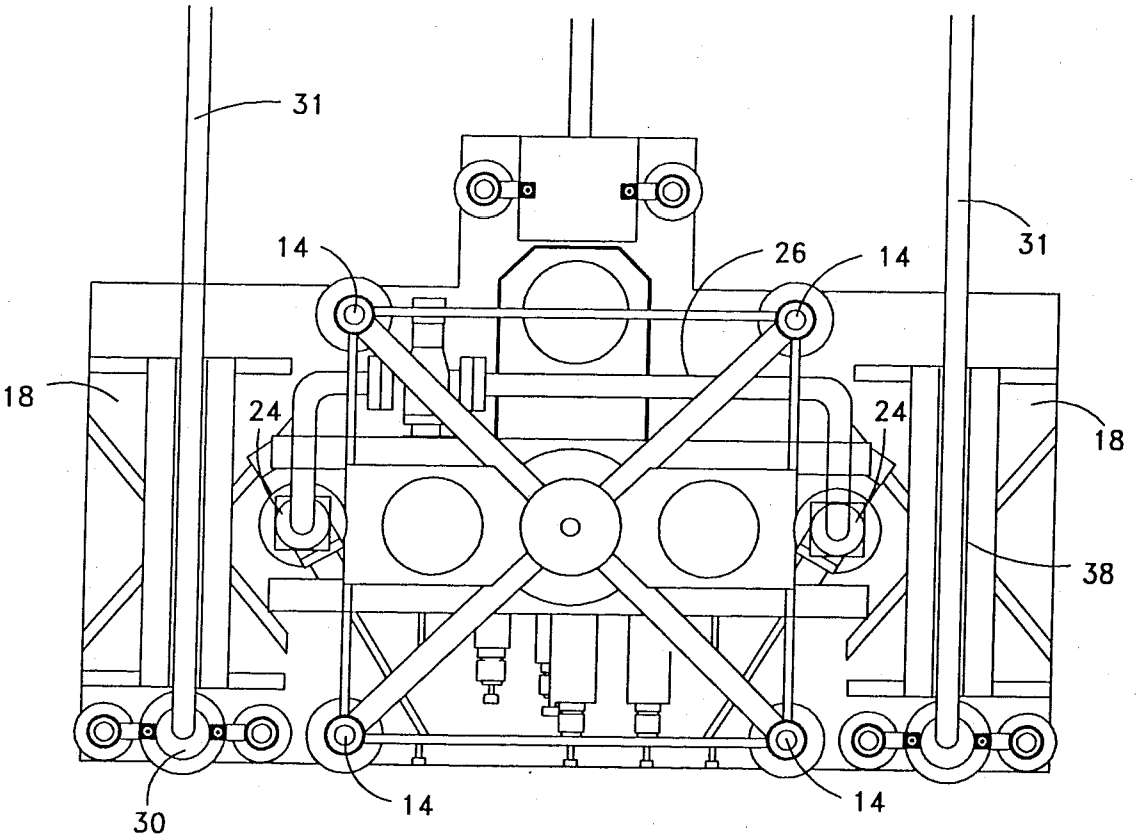
FIG. 2C is a top plane view of the flexible flowline support of FIG. 2A.

As shown in FIG. 1, a subsea guideline wellhead assembly 10 of the type made by Cameron Iron Works is mounted upon a subsea casing 12, as is well known. As is well known in the art, the subsea wellhead assembly 10 involves internal valves and piping for the control of fluid passing to/from concentric piping (not shown) within the casing 12. The subsea wellhead assembly 10 can be lowered onto the casing 12 in separate modules through the use of a plurality of guideposts 14 and guidelines 16 that extend upwardly from the ends of the wellhead assembly 10.

A flowline support base 18 in the form of a rectangular frame or platform can be formed integral with a modular subsection of the subsea wellhead assembly 10. Also, the support base 18 can include a plurality of guide funnels 20 cooperative with the guideposts 14 so that the support base 18 can be mounted to the subsea wellhead assembly 10 while on the seafloor, as is well known. The flowline support base 18 can be a single module extending outwardly from one side of the subsea wellhead assembly 10 or can include a two or more flowline support bases, as shown in FIGS. 1, 2A, 2B, and 2C. Additional flowline support bases 18 can be lowered onto the guideposts 14 or formed as part of the wellhead assembly 10.

A flowline connector 22 comprises a tube or conduit that extends at a first end upwardly through the flowline support base 18, and at a second end, extends upwardly to a wellhead piping connector 24 disposed in a lower portion of the subsea wellhead assembly 10. Integral wellhead connection tubing 26 connects the flowline connector(s) 22 to the necessary valves in an upper portion of the subsea wellhead assembly 10, as is well known in the art. A first end of the flowline connector 22 that extends upwardly through the flowline support base 18 includes hydraulic or mechanical type conduit connection mechanisms 28. A flowline connection device 30 is mounted to one end of a flexible flowline 31 and includes a plurality of guide funnels 32 that are cooperative with guideposts 34 that extend upwardly from the flowline support base 18, and a female type conduit connection mechanism 36 that cooperates with the connection mechanism 28.

To insure that the flexible flowline 31 is not bent in too sharp of a radius, a cradle assembly 38 is mounted to the flowline support base 18. The cradle assembly 38 includes a convex-shaped trough that is mounted to the flowline support base 18 by a plurality of inclined legs 40. The cradle assembly 38 can include flared guide frames or rails 42, as desired.

Once the subsea wellhead assembly 10 has been mounted upon the wellhead 12, the flowline support base 18 can be lowered upon the guideposts 14 using the guidelines 16, as well known in the art, and the other necessary subsea wellhead assemblies can be lowered there upon. Then, the flexible flowline 31 having the connection device 30 at one end thereof is lowered by way of guidelines onto the guideposts 34 and operatively connected to the flowline connector 22. The flowline 31 is draped or laid across the upper surface of the cradle assembly 38, which is curved in a manner to prevent the flowline 31 from being bent in too short of a radius. Thereafter, the flowline 31 is extended horizontally outward along the seafloor and/or upwardly to the desired production equipment.

Wherein the present invention has been described in particular relation to the drawings attached hereto, it should be understood that other and further modifications, apart from those shown or suggested herein, can be made within the scope of the spirit of the present invention.

What is claimed:

1. A flexible flowline support for connection to a subsea wellhead assembly, comprising:

a flow line support base connectable to a subsea wellhead assembly, said flowline support base comprising at least one horizontally disposed frame extending laterally from the subsea wellhead assembly;

a flowline connector having a first end upwardly disposed and mounted to the flowline support base and having a second end operatively connectable to the subsea wellhead assembly; and a cradle assembly mounted to the flowline support base adjacent the first end of the flowline connector, and having a curved trough over which the flexible flowline can lay for connection to the first end of the flowline connector.

2. A flexible flowline support of claim 1 wherein the flowline base includes a plurality of guide funnel assemblies cooperable during installation with a plurality of vertical guideposts extending from the subsea wellhead assembly.

3. A flexible flowline support of claim 1 wherein the flowline connector comprises a conduit having a first end upwardly disposed and including a connection device, and having a second end upwardly disposed and including a connection device adapted for operable connection to the subsea wellhead assembly by relatively vertical movement.

4. A flexible flowline support of claim 1 wherein the cradle assembly comprises said curved trough having a support frame connected to the flowline base support.

5. A flexible flowline support of claim 1 wherein an end of the flexible flowline includes a guideline guided connection device cooperable by relative vertical movement with the first end of the flowline connector.

6. A method of connecting a flexible flowline to a subsea wellhead assembly, comprising:

(a) lowering a flexible flowline, having on a lower end thereof a guideline guided connection device, into operative connection to a flowline connector extending upwardly through a flowline support base comprising a horizontally disposed frame extending laterally from the subsea wellhead assembly; and (b) laying the flexible flowline over a curved trough on a cradle assembly mounted to the flowline support base to prevent undesired bending of the flexible flowline as it extends from the flowline support base.

7. A flexible flowline support for connection to a subsea wellhead assembly, comprising:

a flowline support base connectable to a subsea wellhead assembly;

a flowline connector having a first end upwardly disposed and mounted to the flowline support base and having a second end operatively connectably to the subsea wellhead assembly, said flowline connector comprising a conduit having a first end upwardly disposed and including a connection device, and having a second end upwardly disposed and including a connection device adapted for operable connection to the subsea wellhead assembly by relatively vertical movement; and a cradle assembly mounted to the flowline support base adjacent the first end of the flowline connector, and having a receiving surface over which the flexible flowline can lay for connection to the first end of the flowline connector.

* * * * *